US010327492B1

(12) United States Patent
Trujillo

(10) Patent No.: US 10,327,492 B1
(45) Date of Patent: Jun. 25, 2019

(54) ADJUSTABLE WIDTH BRASSIERE STRAP

(71) Applicant: Stacy M. Trujillo, San Antonio, TX (US)

(72) Inventor: Stacy M. Trujillo, San Antonio, TX (US)

( * ) Notice: Subject to any disclaimer, the term of this patent is extended or adjusted under 35 U.S.C. 154(b) by 0 days.

(21) Appl. No.: 15/784,104

(22) Filed: Oct. 14, 2017

(51) Int. Cl.
*A41F 15/00* (2006.01)

(52) U.S. Cl.
CPC ..... *A41F 15/002* (2013.01)

(58) Field of Classification Search
CPC ..... A41F 15/00; A41F 15/002
USPC ..... 450/86; 2/326, 327
See application file for complete search history.

(56) References Cited

U.S. PATENT DOCUMENTS 2,763,866 A * 9/1956 Anderson ..... A41F 15/00 2/323
3,046,991 A * 7/1962 Heberling ..... A41F 15/02 2/460

* cited by examiner

*Primary Examiner* — Gloria M Hale
(74) *Attorney, Agent, or Firm* — Wayne J. Colton, Inc.

(57) ABSTRACT

An adjustable width brassiere strap for selectively providing arm support of a brassiere includes an elongate central panel having a front end and a back end; a bottom pleat affixed along a first edge of the elongate central panel; a top pleat affixed along a second edge, opposite the first edge, of elongate central panel; and wherein the pleats and said central panel are affixed, one to another, et each of the ends of the central panel. In use, the brassier strap is adjustable from an otherwise "conventional" dimension to a "widened" dimension.

6 Claims, 8 Drawing Sheets

ADJUSTABLE WIDTH BRASSIERE STRAP

FIELD OF THE INVENTION

The present invention relates to clothing. More particularly, the invention relates to an brassiere strap that is adjustable in width to transform from a strap having otherwise conventional width to a strap adapted to conform over and about a substantial portion of a user's shoulder region.

BACKGROUND OF THE INVENTION

For many women, finding a brassiere that is adequately supportive, comfortable and appropriate for selected attire is a daily exercise in futility. At the heart of this frustration, Applicant has discovered, is the fixed strap as generally ubiquitous in the art. While such straps typically comprise length adjustments, little more has heretofore been provided.

With the persistent shortcomings of the prior art clearly in mind, it is therefore an overriding object of the present invention to improve over the prior art by providing a brassier strap that is adjustable in width.

It is an additional object of the present invention to provide such an adjustable brassier strap that is stepwise adjustable.

It is a still further object of the present invention to provide such an adjustable brassier strap that is adjustable such that the width of the strap can be extended toward the user's arm, toward the user's neck, or both.

It is also an object of the present invention to provide such an adjustable brassier strap that also readily accommodates repositioning of the strap on and about the user's shoulder region.

Finally, it is an object of the present invention to provide such an adjustable brassier strap that is readily usable with virtually any otherwise conventional brassier design, and that is economically manufactured, thereby ensuring that the improved brassiere strap of the present invention may be made widely available.

SUMMARY OF THE INVENTION

In accordance with the foregoing objects, the present invention—an adjustable width brassiere strap for selectively providing arm support of a brassiere—generally comprises an elongate central panel having a front end and a back end; a bottom pleat affixed along a first edge of the elongate central panel; a top pleat affixed along a second edge, opposite the first edge, of elongate central panel; and wherein the pleats and said central panel are affixed, one to another, at each of the ends of the central panel. In use, the brassier strap is adjustable from an otherwise "conventional" dimension to a "widened" dimension.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 1:
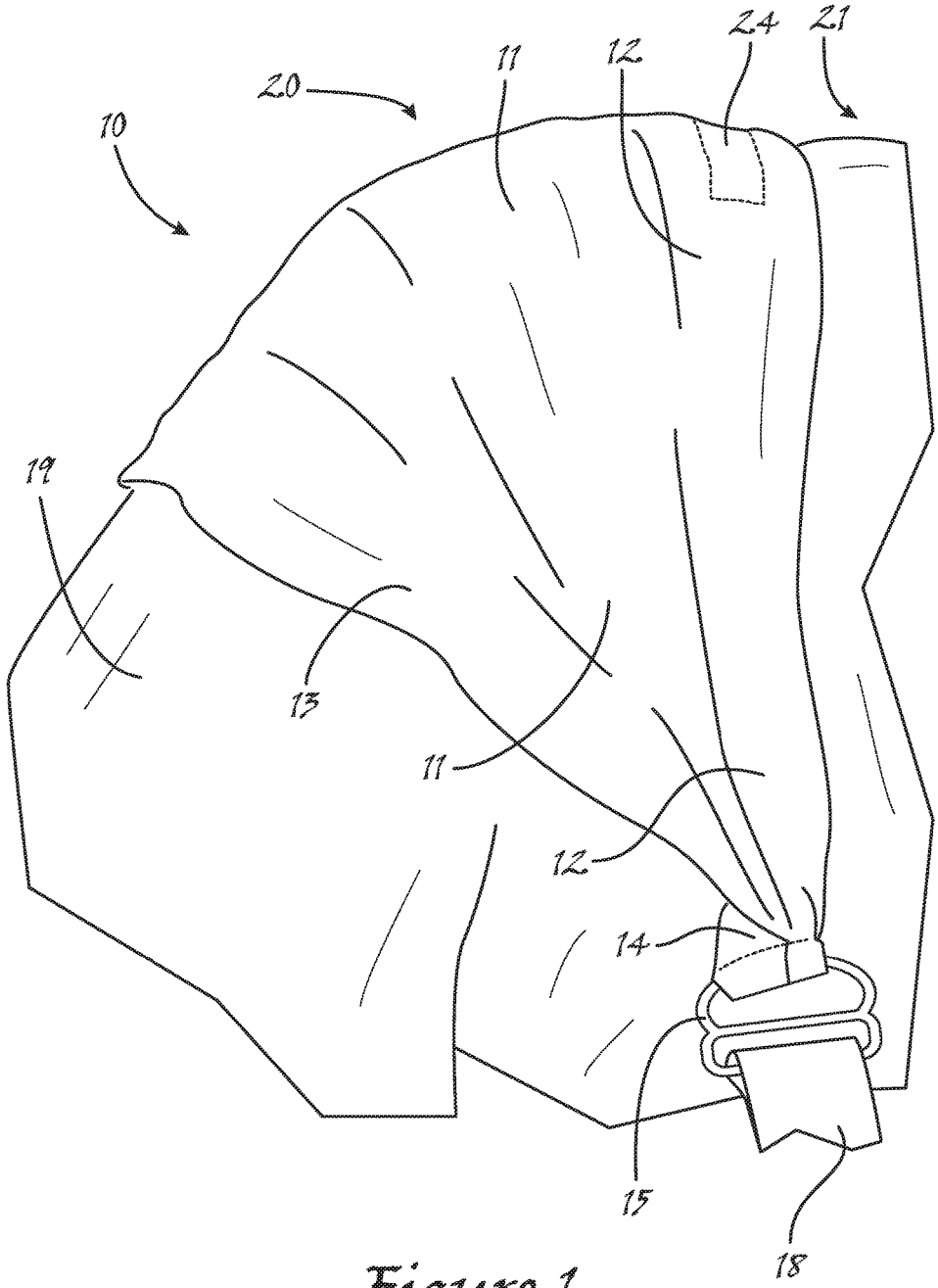
FIG. 1 shows, in front perspective view, a preferred implementation according to the present invention of an adjustable width brassiere strap, as utilized by a user.
Figure 2:
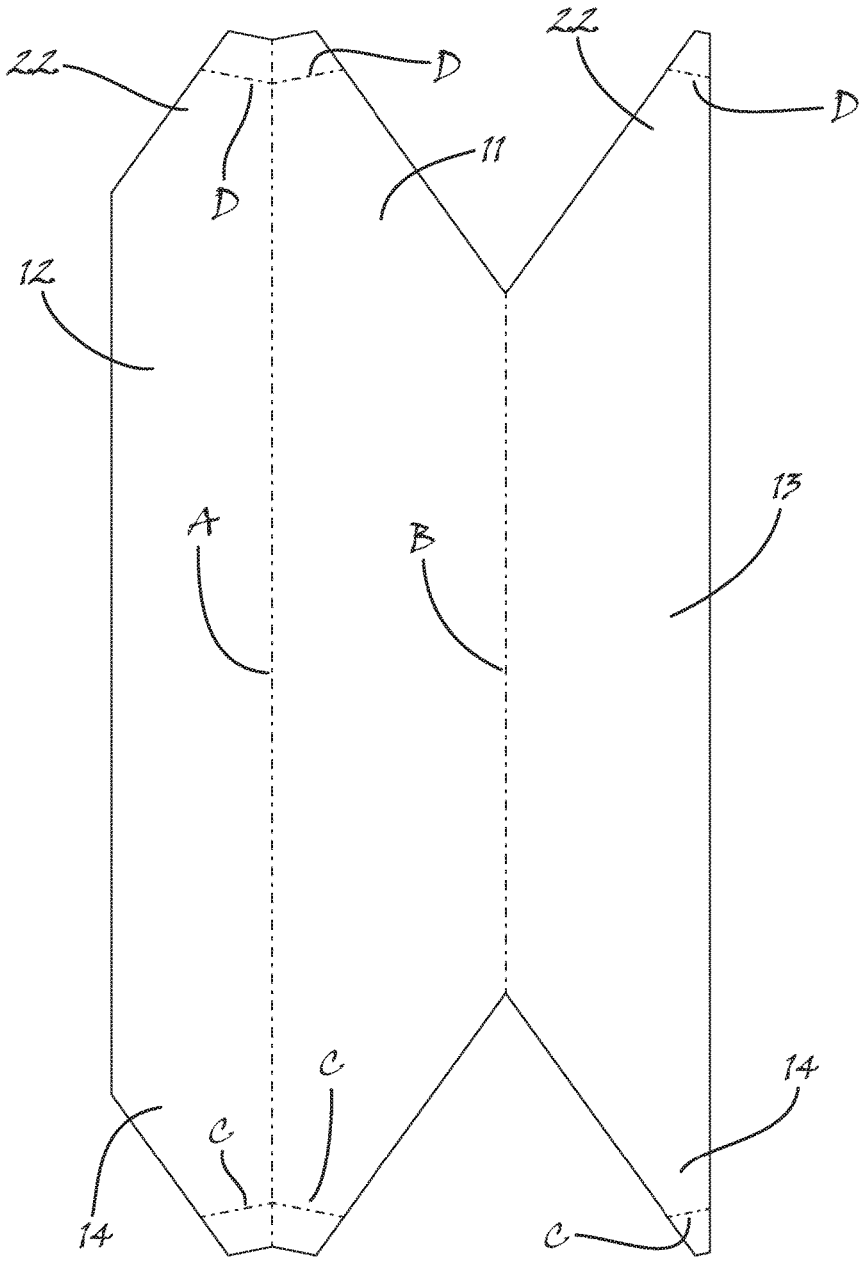
FIG. 2 shows, in a bottom plan view, a preferred fabric cutout pattern for the brassiere strap of FIG. 1, showing also various fold lines as utilized in the further assembly of the brassiere strap.
Figure 7:
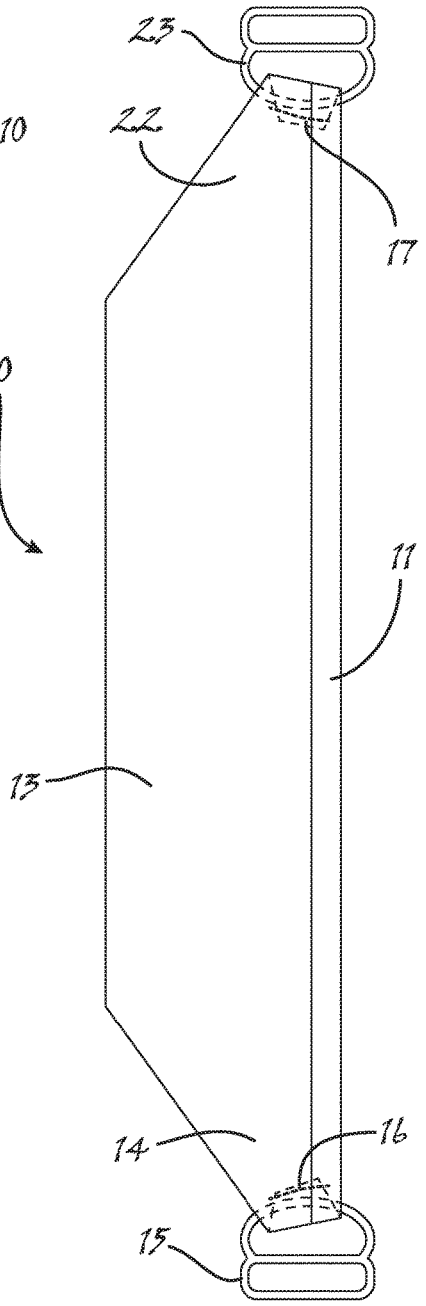
FIG. 7 shows, in a top plan view corresponding to the view of FIG. 5, various additional details of the final assembly of the brassiere strap of FIG. 1.

Referring now to the figures, and to FIGS. 1, 2 and 7 in particular, the adjustable width brassier strap 10 of the present invention is shown to generally comprise a preferably fabric elongate central panel 11 having formed unitary or integral therewith a preferably fabric bottom pleat 12 and a preferably fabric top pleat 13, the critical arrangement of the pleats 12, 13 and the central panel 11 being such that, in use, the brassier strap 10 is adjustable from an otherwise "conventional" dimension, similar to that shown in FIG. 7, to a "widened" dimension, such as that shown in FIG. 1. Additionally, at least the most preferred implementations of the present invention comprises a rear swivel ring 23 provided at the intersection between the back end 22 of the adjustable width brassier strap 10 and the otherwise provided, preferably adjustable wing strap or other connection to the upper edge of the associated brassier wing, in addition to a front swivel ring 15 provided at the intersection between the front end 14 of the adjustable width brassier strap 10 and the otherwise provided, preferably adjustable cup strap 18 or other connection to the upper end of the associated brassier cup.

Referring now to FIG. 2, in particular, a preferred fabric cutout pattern, suitable for achieving the foregoing critical characteristics, is shown. As will be better understood further herein, the depicted pattern, configured as described in the passages following, will result in a brassiere strap 10 that, in its narrowest configuration, lies generally flat, as shown in FIG. 7, but that, in its widened configurations, takes a markedly concave shape, as shown in FIG. 1, such that the widened brassiere strap 10 generally conforms over and about the should region 20 of the user, and also a portion of the user's upper 19 and, if fully widened in the direction of the user's neck 21, is adapted to fully retain shoulder support notwithstanding being canted toward the user's arm 19. In any case, it is noted at this point that the exemplary embodiment depicted is shown and described for a "right" strap in particular. As should be appreciated by those of ordinary skill in the art in light of this exemplary description, however, the corresponding "left" strap is constructed and utilized as a mirror image of that shown in the present figures.

Figure 3:
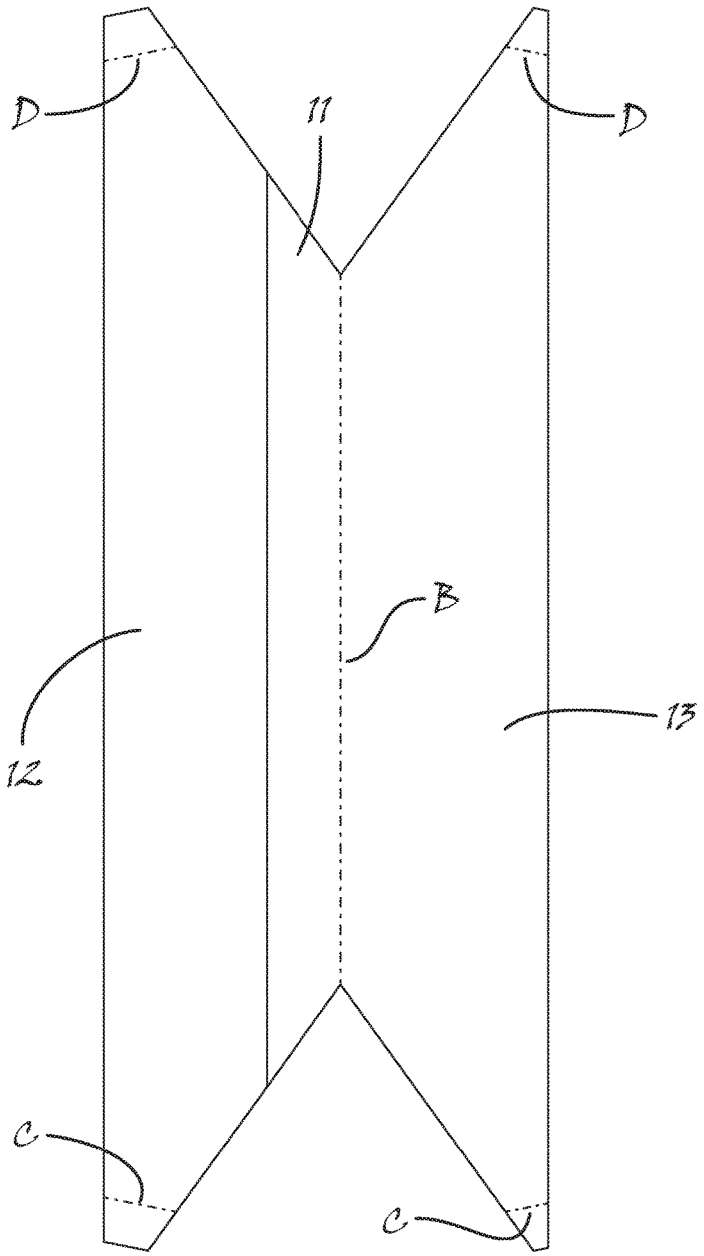
FIG. 3 shows, in a bottom plan view generally corresponding to the view of FIG. 2, various details of the assembly of the brassiere strap of FIG. 1.
Figure 4:
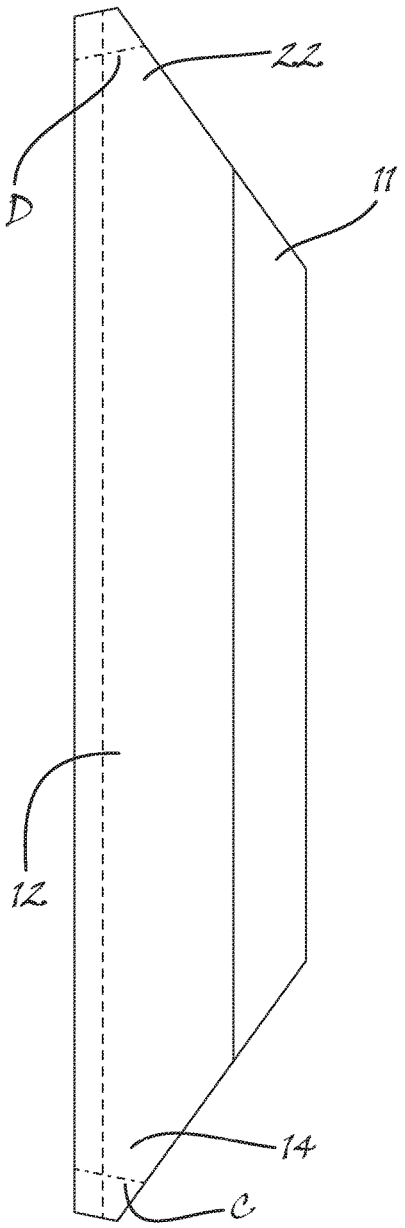
FIG. 4 shows, in a bottom plan view generally corresponding to the view of FIGS. 2 and 3, various additional details of the assembly of the brassiere strap of FIG. 1.
Figure 5:
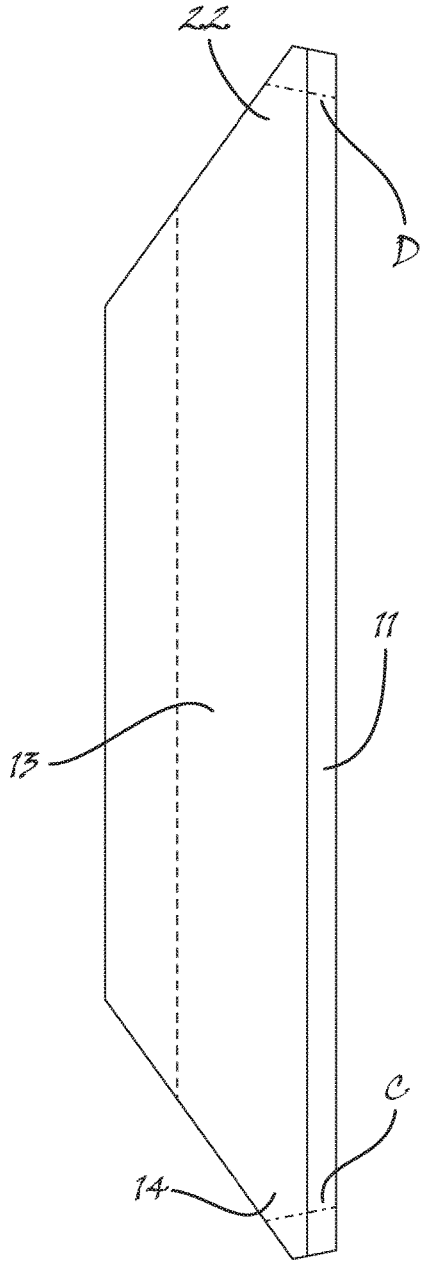
FIG. 5 shown, in a top plan view generally opposite the view of FIG. 4, still further details of the assembly of the brassiere strap of FIG. 1.

Referring now to FIGS. 3 through 4, a construction of the adjustable width brassier strap 10 of the present invention continues with a series of folds. First, as shown in FIG. 3, the bottom pleat 12 is folded, along the depicted first pleat fold line A, up and over the center panel 11. Next, the top pleat 13 is folded, along the depicted front end fold line B, down and under the center panel 11, resulting in the arrangement of FIG. 4, which shows the partially manufactured adjustable width brassier strap 10 in a bottom plan view. FIG. 5 shows the adjustable width brassier strap 10 in the same state of manufacture as is depicted in FIG. 4, but in a top plan view. As shown in FIGS. 4 and 5, it is noted that at this point the front end fold lines C lie atop one another and the back end fold lines D likewise also lie atop one another.

Figure 6:
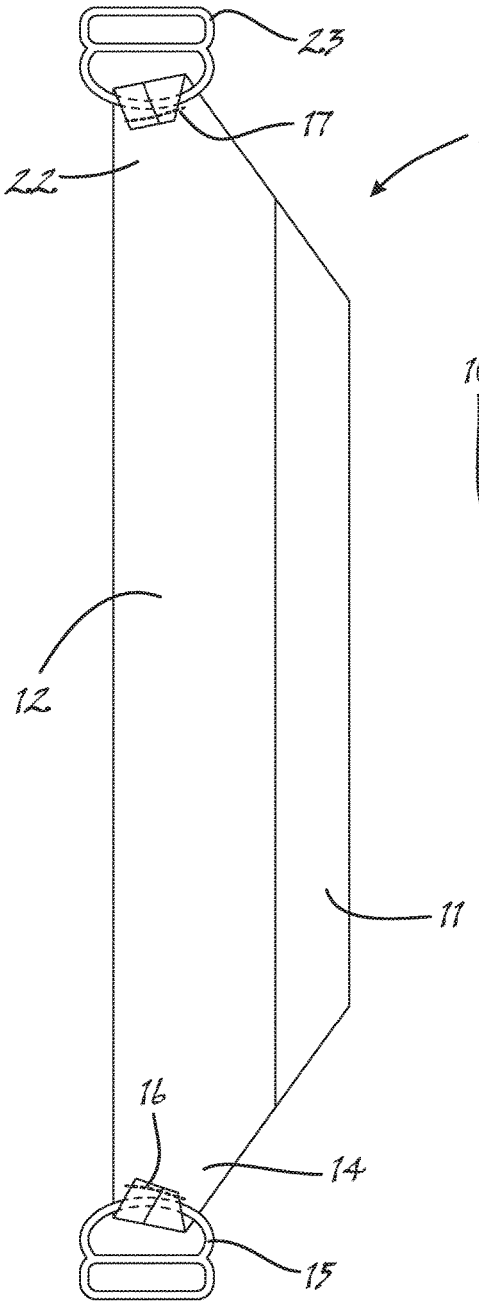
FIG. 6 shows, in a bottom plan view corresponding to the view of FIG. 4, various details of the final assembly of the brassiere strap of FIG. 1, including provision of swivel rings and stitching.

In completion of the manufacture of the adjustable width brassier strap 10 of the present invention, a front strap swivel ring 15 and, most preferably, also a rear strap swivel ring 23, is affixed to the respective front end 14 and back end 22. As shown in FIGS. 6 and 7, the front strap swivel ring 15 is positioned at the front end 14 of the brassier strap 10, and the tip of the front end 14 of the brassier strap 10 is folded, along the depicted front end fold line C, over and about the front strap swivel ring 15, and affixed with stitching 16 or the like. Similarly, the rear strap swivel ring 23 is positioned at the back end 22 of the brassier strap 10, and the tip of the back end 22 of the brassier strap 10 is folded, along the depicted back end fold line D, over and about the rear strap swivel ring 22, and affixed with stitching 17 or the like.

With the adjustable width brassier strap 10 of the present invention manufactured as described, brassier strap 10 is integrated with an otherwise conventional brassier, as are well known in the art. In the exemplary embodiment as shown and described, the rear swivel ring 23 is affixed to the wing strap or other connection to the upper edge of the associated brassier wing. Similarly, the front swivel ring 15 is affixed to cup strap 18 or other connection to the upper end of the associated brassier cup.

Figure 8:
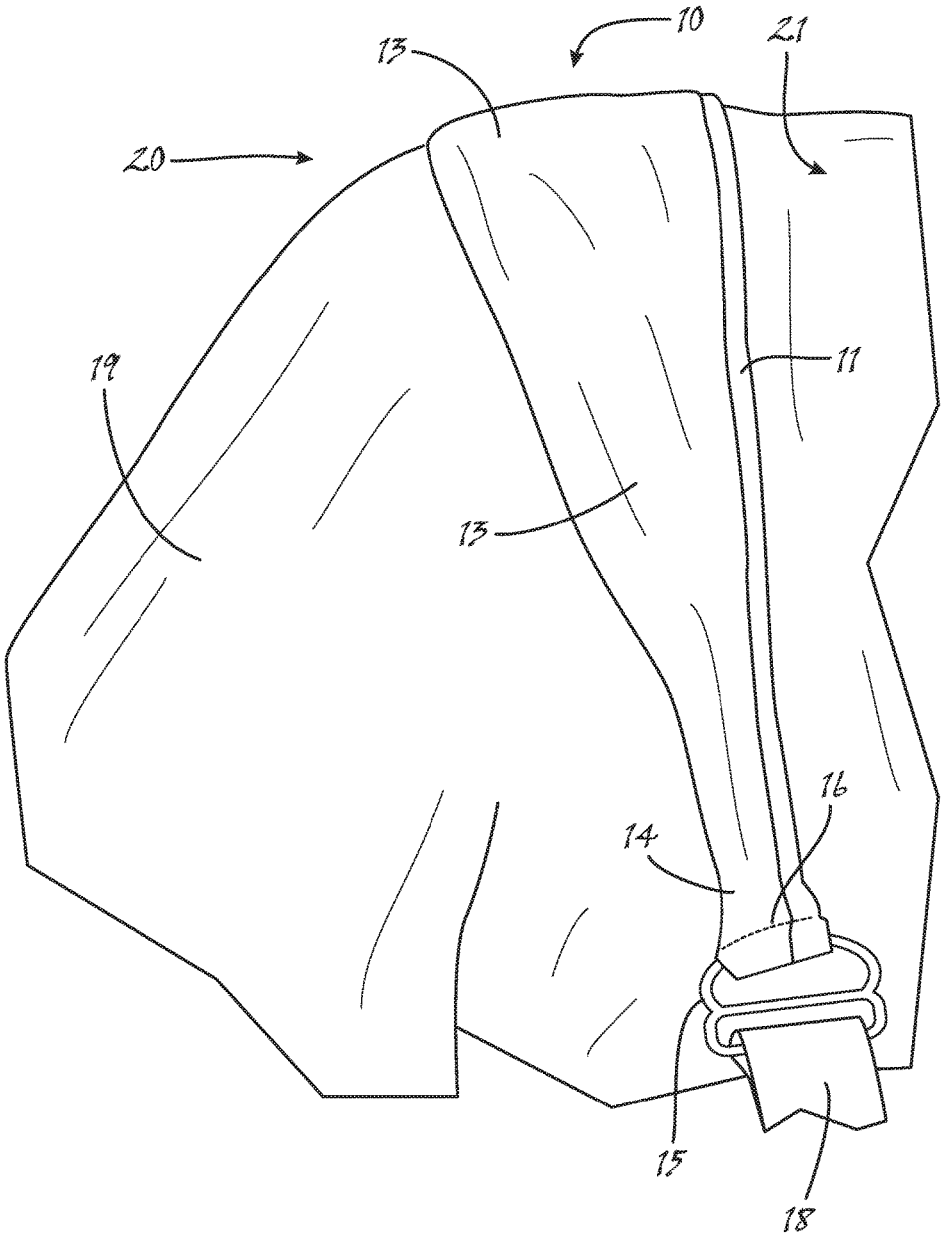
FIG. 8 shows, in a front perspective view generally corresponding to the view of FIG. 1, the adjustable width brassiere strap of FIG. 1, as initially donned by a user.
Figure 9:
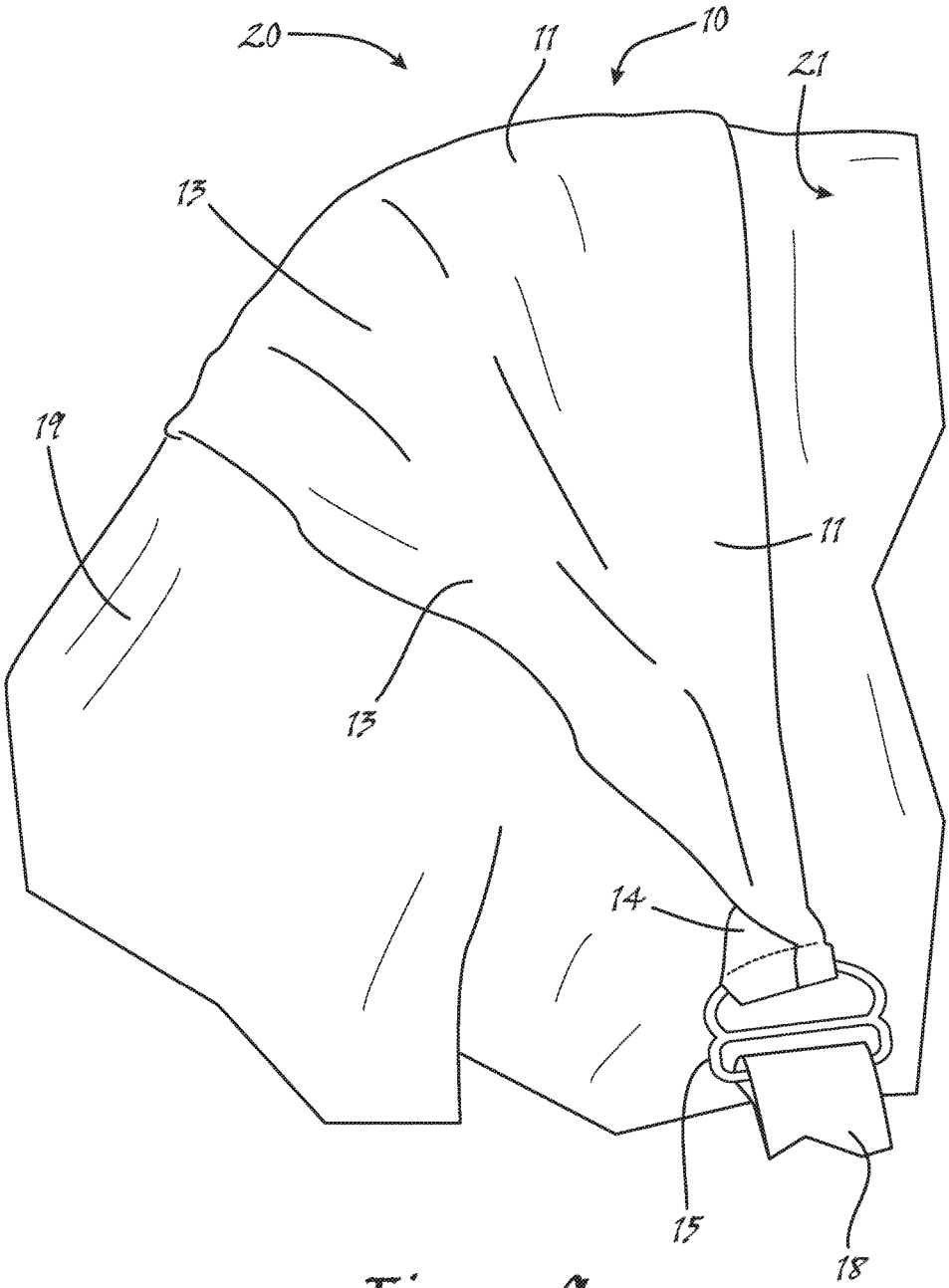
FIG. 9 shows, in a front perspective view generally corresponding to the view of FIG. 1, the adjustable width brassiere strap of FIG. 1, as deployed by a user for the provision of "arm" support.

In use, a brassiere integrating the adjustable width brassier strap 10 of the present invention will typically be donned with the brassier strap 10 in the narrow configuration as generally depicted in FIGS. 7 and 8. In the event that the user should desire "arm" support, however, the user will unfold the top pleat 13, pulling the free edge in the direction of the user's arm 19, as shown in FIG. 9. At this point, the "twist" generated in the top pleat 13 adjacent the ends 14, 22 of the adjustable width brassier strap 10 will shorten the top pleat 13, and cause the brassier strap 10 to take a concave shape conforming to the interface between the user's arm 19 and shoulder 20. If the user wishes to rotate the brassier strap 10 further toward the user's arm 19, the user may also unfold the bottom pleat 12, pulling the free edge in the direction of the user's neck 21 as the brassier strap 10 as a whole is rotated in the opposite direction, as shown in FIG. 1. In this manner, the bottom pleat 12, which as described with respect to the top pleat 12 will also contribute to the concave shaping of the brassier strap 10, will serve to ensure that sufficient shoulder support remains notwithstanding the shift toward arm support. As also shown in FIG. 1, however, the underside of the bottom pleat 12 may, if desired, be provided with a silicone or substantially equivalent grip 24, which grip 24 will prevent unintended sliding off the user's shoulder 20 and down the user's arm 19 of the adjustable width brassier strap 10.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. For example, aesthetically pleasing ornamental designs may be incorporated into the adjustable width brassier strap 10, and especially the top pleat 12, thereby ensuring that any area of the brassier strap 10 that is exposed to view presents a desired look.

Additionally, those of ordinary skill in the art will recognize, in light of this exemplary description, that the adjustable width brassier strap 10 may readily be integrated, or otherwise incorporated or adapted for use, with a cross-back style brassier.

Figure 10:
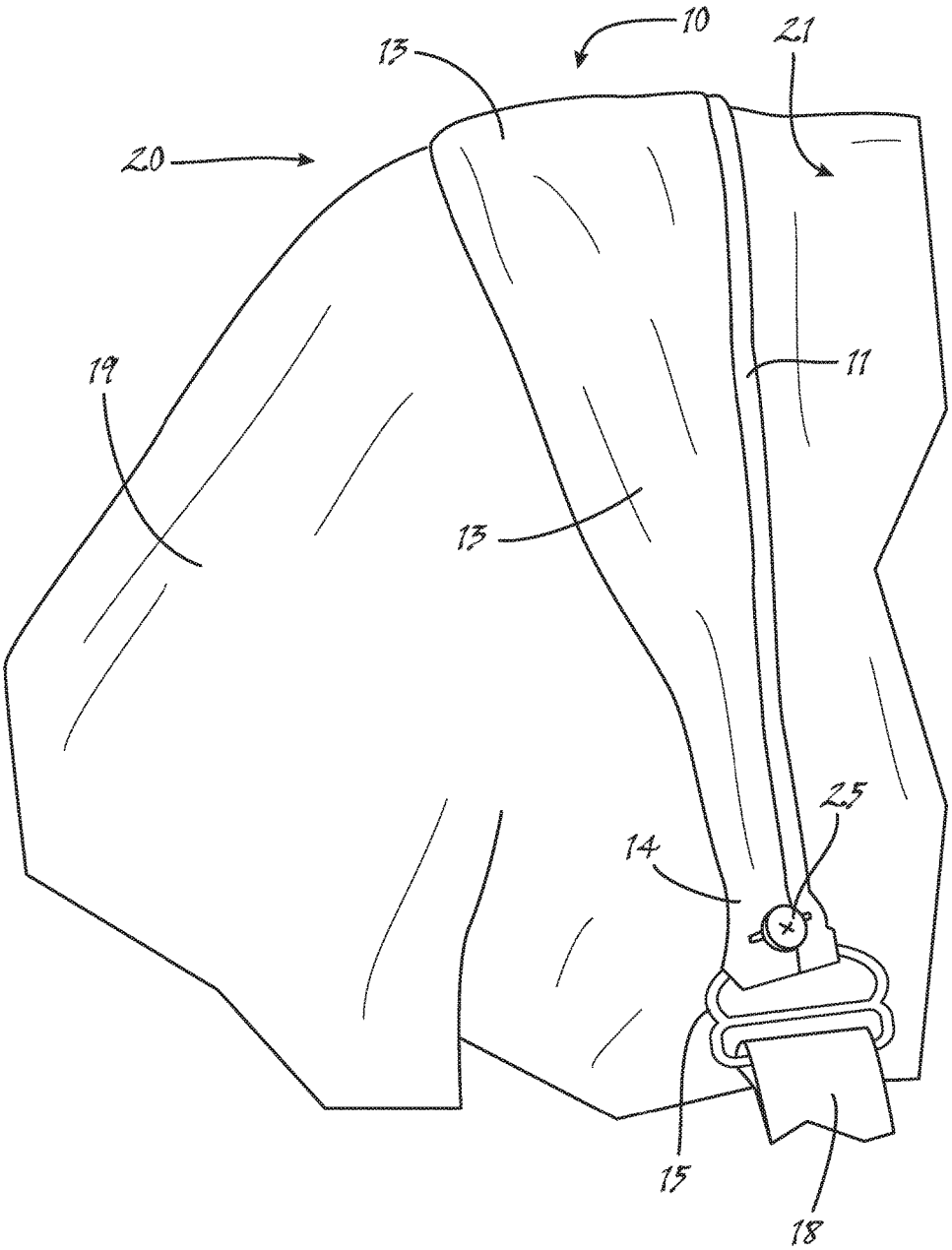
FIG. 10 shows, in a front perspective view generally corresponding to the view of FIG. 1, an alternative implementation of the adjustable width brassiere strap of FIG. 1, particularly showing provision for removal and replacement of the strap with respect to otherwise conventional elements of a brassiere.

Still further, and as shown in FIG. 10, the buttons 25, or substantially equivalent selectively releasable fasteners, may be substituted for the stitching 16, 17 securing the front and rear strap rings 15, 23, respectively, thereby enabling the user to "swap out" sizes of the adjustable width brassier strap 10 of the present invention, or to incorporate the adjustable width brassier strap 10 into an otherwise conventional brassiere. In any case, because the scope of the present invention is much broader than any particular embodiment, the foregoing detailed description should not be construed as a limitation of the scope of the present invention, which is limited only by the claims appended hereto.

What is claimed is:

1. An adjustable width brassiere strap for selectively providing additional support of a brassiere, said adjustable width brassiere strap comprising:

an elongate central panel, said elongate central panel having a front end and a back end;

a bottom pleat panel affixed along a first edge of said elongate central panel;

a top pleat panel affixed along a second edge, opposite said first edge, of said elongate central panel; and wherein each said pleat panel and said elongate central panel are affixed, one to another, at each of said ends of said elongate central panel.

2. The adjustable width brassiere strap as recited in claim 1, wherein said top pleat panel is adapted to widen, and thereby impart a concave shape to, said adjustable width brassiere strap.

3. The adjustable width brassiere strap as recited in claim 2, wherein said bottom pleat panel is adapted to widen, and thereby impart a concave shape to, said adjustable width brassiere strap.

4. The adjustable width brassiere strap as recited in claim 3, wherein said front end of said brassiere strap has a front strap ring affixed thereto.

5. The adjustable width brassiere strap as recited in claim 3, wherein said back end of said brassiere strap has a rear strap ring affixed thereto.

6. The adjustable width brassiere strap as recited in claim 1, wherein said bottom pleat panel is adapted to widen, and thereby impart a concave shape to, said adjustable width brassiere strap.

* * * * *